US009493903B2

(12) United States Patent
Yu et al.

(10) Patent No.: US 9,493,903 B2
(45) Date of Patent: Nov. 15, 2016

(54) IMPELLER ASSEMBLY FOR AN APPLIANCE

(71) Applicant: General Electric Company, Schenectady, NY (US)

(72) Inventors: Zhiquan Yu, Mason, OH (US); Joseph Lee McLain, Crestwood, KY (US); Nemetalla Salameh, Louisville, KY (US); Ronald Miles Johnson, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 81 days.

(21) Appl. No.: 14/524,235

(22) Filed: Oct. 27, 2014

(65) Prior Publication Data

US 2016/0115970 A1 Apr. 28, 2016

(51) Int. Cl.

| | |
|---|---|
| ***D06F 58/20*** | (2006.01) |
| ***F04D 29/28*** | (2006.01) |
| ***F04D 29/66*** | (2006.01) |

(52) U.S. Cl.

CPC ..... *D06F 58/20* (2013.01); *F04D 29/282* (2013.01); *F04D 29/666* (2013.01)

(58) Field of Classification Search

CPC ..... F26B 19/00; F26B 21/00; F26B 21/06; D06F 58/00; D06F 58/12; D06F 58/20

USPC ..... 34/601, 606, 610; 68/5 C, 5 R, 19, 20

See application file for complete search history.

(56) References Cited

U.S. PATENT DOCUMENTS 3,851,993 A * 12/1974 Foster ..... A47L 15/4225 415/200
3,953,150 A * 4/1976 Onal ..... F04D 1/006 416/175
4,360,977 A * 11/1982 Frohbieter ..... D06F 58/20 165/7
4,981,414 A * 1/1991 Sheets ..... F01D 5/145 415/149.1
5,152,661 A * 10/1992 Sheets ..... F01D 5/145 415/206
5,713,139 A * 2/1998 Briggs ..... D06F 58/04 34/602
5,730,580 A * 3/1998 Japikse ..... F01D 17/16 415/208.1
5,743,281 A * 4/1998 Sargeant ..... A47L 15/0084 134/176
5,785,507 A * 7/1998 Hanneken ..... F04D 13/08 415/214.1
6,164,909 A * 12/2000 Ehlers ..... F04D 29/281 165/140
6,227,817 B1 * 5/2001 Paden ..... A61M 1/101 417/356
6,302,661 B1 * 10/2001 Khanwilkar ..... A61M 1/101 415/900
8,011,114 B2 * 9/2011 Johnson ..... F26B 21/001 15/300.1
8,051,578 B2 * 11/2011 Kohlrusch ..... D06F 58/20 264/310
8,104,191 B2 * 1/2012 Ricklefs ..... D06F 58/203 34/474
8,398,380 B2 3/2013 Duke
8,939,719 B2 * 1/2015 Wan ..... F04D 29/426 415/206

(Continued)

FOREIGN PATENT DOCUMENTS

| | | |
|---|---|---|
| CN | 2701895 Y | 5/2005 |
| JP | 2007209419 A | 8/2007 |

*Primary Examiner* — Stephen M Gravini

(74) *Attorney, Agent, or Firm* — Dority & Manning, P.A.

(57) ABSTRACT

An impeller assembly including a housing and an impeller is provided. The impeller is positioned within a volute of the housing and includes a hub and a plurality of blades. The plurality of blades are spaced about the hub along a circumferential direction of the impeller. The plurality of blades include a first pair of blades and a second pair blades. The first pair blades defines a first gap along the circumferential direction at a radially outer portion, and the second pair blades defines a second gap along the circumferential direction at a radially outer portion. The first gap is unequal to the second gap in order to reduce an amount of noise generated by the impeller assembly.

8 Claims, 5 Drawing Sheets

(56) References Cited

U.S. PATENT DOCUMENTS

| | | | | |
|---|---|---|---|---|
| 9,057,153 | B2 * | 6/2015 | Yu | D06F 58/10 |
| 9,243,844 | B2 * | 1/2016 | Yu | F26B 21/004 |
| 2004/0151579 | A1 * | 8/2004 | Lawlor | F04D 21/00 415/71 |
| 2012/0118023 | A1 * | 5/2012 | Guerrero Lara | D06F 13/06 68/12.19 |
| 2016/0097399 | A1 * | 4/2016 | Stoicescu | F02M 37/18 415/203 |
| 2016/0115970 | A1 * | 4/2016 | Yu | F04D 29/4206 34/108 |

* cited by examiner

IMPELLER ASSEMBLY FOR AN APPLIANCE

FIELD OF THE INVENTION

The present subject matter relates generally to an impeller assembly for appliances, such as dryer appliances.

BACKGROUND OF THE INVENTION

Dryer appliances generally include a cabinet with a drum rotatably mounted therein. A motor can selectively rotate the drum during operation of the dryer appliance, e.g., to tumble articles located within a chamber defined by the drum. Dryer appliances also generally include a heater assembly that passes heated air through the chamber of the drum in order to dry moisture laden articles disposed within the chamber.

To circulate heated air, certain dryer appliances include an impeller assembly, the impeller assembly including an impeller positioned within a housing. During operation of the dryer appliance, the impeller urges a flow of heated air into the chamber of the drum. Such heated air absorbs moisture from articles disposed within the chamber. The impeller also urges moisture laden air out of the chamber through a vent. The vent can be connected to household ductwork that directs the moisture laden air outdoors.

Conventionally, impellers include a plurality of blades mounted to a hub. However, the arrangement of blades may result in a spike in a sound power level due to a consistent frequency at which the plurality of blades pass a cut-off edge defined between a volute and a transition member of the housing.

Accordingly, an impeller assembly for a dryer appliance with features for reducing a spike in sound power level during operation of the impeller assembly would be beneficial. More particularly, an impeller assembly with one or more features for disrupting the frequency at which the plurality of blades pass the cut-off edge during operation of the impeller assembly would be particularly useful.

BRIEF DESCRIPTION OF THE INVENTION

Aspects and advantages of the invention will be set forth in part in the following description, or may be apparent from the description, or may be learned through practice of the invention.

In a first exemplary embodiment, a dryer appliance is provided. The dryer appliance includes a cabinet, a motor positioned within the cabinet, and a housing positioned within the cabinet. The housing including a volute and a transition member. The dryer appliance also includes an impeller defining an axial direction, a radial direction, and a circumferential direction. The impeller is rotatable about the axial direction and is positioned within the volute of the housing. The impeller is in mechanical communication with the motor and is rotatable with the motor in order to urge a flow of air from the volute to the transition member. The impeller includes a hub and a plurality of blades, the hub positioned at a center of the impeller and the plurality of blades spaced about the hub along the circumferential direction. The plurality of blades include a first pair of blades and a second pair of blades. The first pair of blades defines a first gap along the circumferential direction at a radially outer portion and the second pair of blades defines a second gap along the circumferential direction at a radially outer portion. The first gap is unequal to the second gap.

In a second exemplary embodiment, an impeller assembly for a dryer appliance is provided. The impeller assembly includes a housing including a volute and a transition member. The housing is configured to be positioned in a cabinet of the dryer appliance. The impeller assembly also includes an impeller defining an axial direction and a circumferential direction. The impeller is rotatable about the axial direction and is positioned within the volute of the housing. The impeller is configured to urge a flow of air from the volute to the transition member. The impeller includes a hub and a plurality of blades, the hub positioned at a center of the impeller and the plurality of blades spaced about the hub along the circumferential direction. Each of the plurality of blades defines an outer tip, and each outer tip defines a gap having a gap length with an adjacent outer tip. The gap lengths of consecutive gaps are unequal, and the gap lengths of a plurality of consecutive gaps are repeated sequentially.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
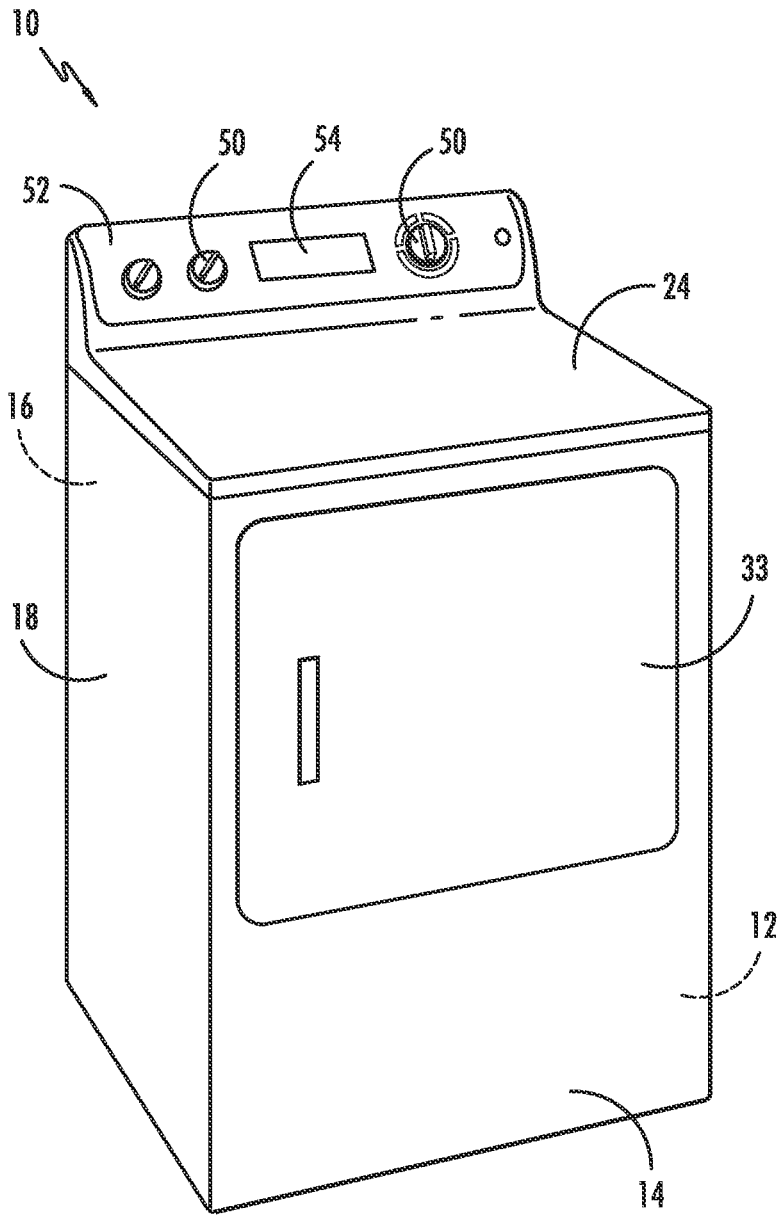
FIG. 1 provides a perspective view of a dryer appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to but need not be limited to fabrics, textiles, garments (or clothing), and linens. Furthermore, the term "load" or "laundry load" refers to the combination of articles that may be washed together in a washing machine or dried together in a laundry dryer (i.e., a clothes dryer) and may include a mixture of different or similar articles of different or similar types and kinds of fabrics, textiles, garments and linens within a particular laundering process.

Figure 2:
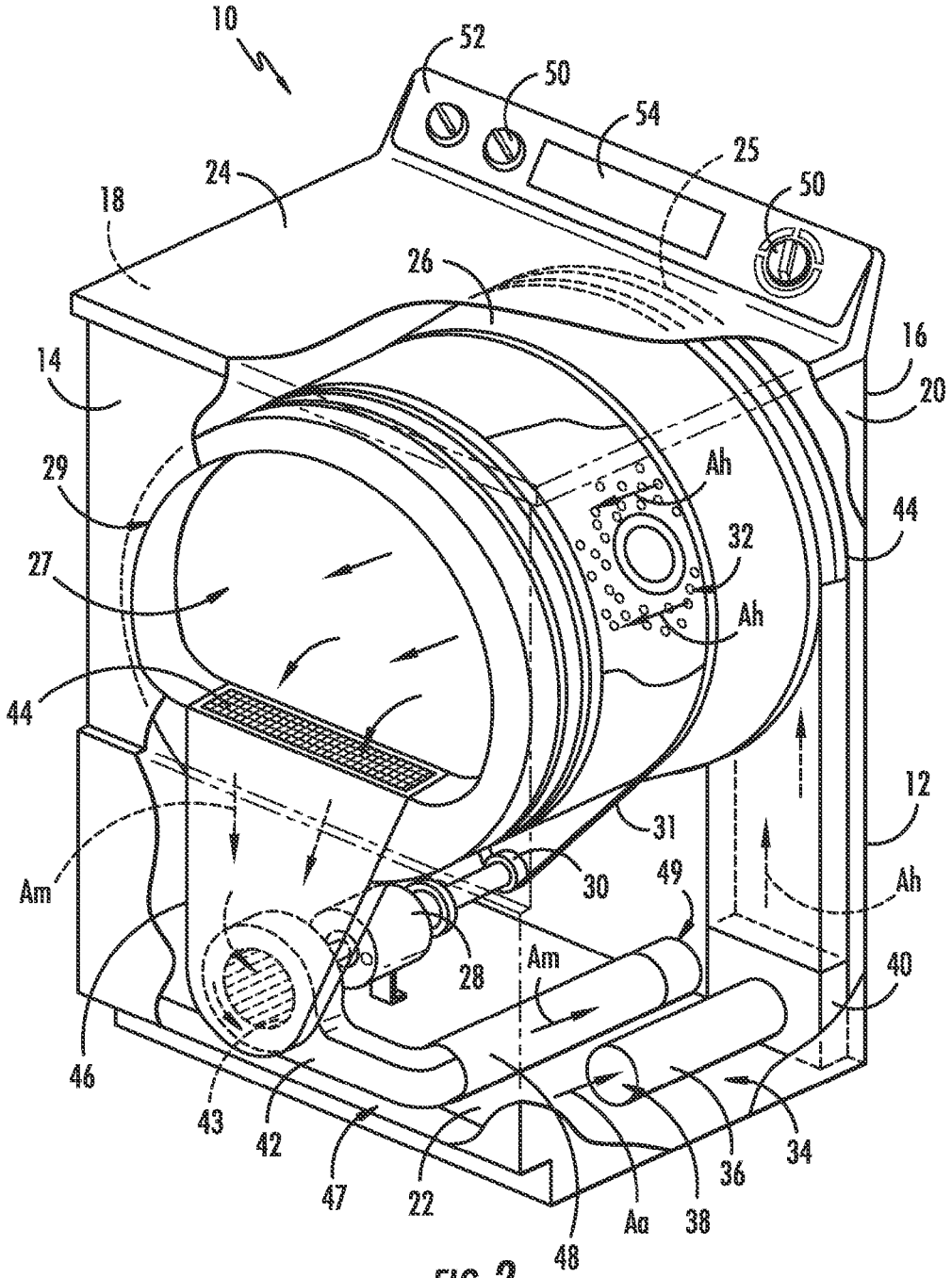
FIG. 2 provides a perspective view of the exemplary dryer appliance of FIG. 1 with a portion of a cabinet of the exemplary dryer appliance removed to reveal certain internal components of the exemplary dryer appliance.

FIGS. 1 and 2 illustrate a dryer appliance 10 according to an exemplary embodiment of the present subject matter. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. For example, dryer appliance 10 illustrated in FIGS. 1 and 2 is a gas dryer appliance with a combustion chamber 36. In alternative exemplary embodiments, however, dryer appliance 10 may be an electric dryer appliance with electric heating elements replacing combustion chamber 36, or a heat pump clothes dryer appliance.

Dryer appliance 10 includes a cabinet 12 having a front panel 14, a rear panel 16, a pair of side panels 18 and 20 spaced apart from each other by front and rear panels 14 and 16, a bottom panel 22, and a top cover 24. Within cabinet 12 is a drum or container 26 mounted for rotation about a substantially horizontal axis. Drum 26 is generally cylindrical in shape and defines a chamber 27 for receipt of articles for drying.

Drum 26 also defines an opening 29 for permitting access to the chamber 27 of drum 26. Opening 29 of drum 26, e.g., permits loading and unloading of clothing articles and other fabrics from chamber 27 of drum 26. A door 33 is rotatably mounted at opening 29 and selectively hinders access to chamber 27 of drum 26 through opening 29.

Drum 26 includes a rear wall 25 rotatably supported within cabinet 12 by a suitable fixed bearing. Rear wall 25 can be fixed or can be rotatable. A motor 28 rotates the drum 26 about the horizontal axis through a pulley 30 and a belt 31. Motor 28 is also in mechanical communication with a fan or air handler 42 such that motor 28 rotates an impeller 43, e.g., a centrifugal impeller, of air handler 42. Air handler 42 is configured for drawing air through chamber 27 of drum 26, e.g., in order to dry articles located therein as discussed in greater detail below. In alternative exemplary embodiments, dryer appliance 10 may include an additional motor (not shown) for rotating impeller 43 of air handler 42 independently of drum 26.

Drum 26 is configured to receive heated air that has been heated by a heater assembly 34, e.g., in order to dry damp articles disposed within chamber 27 of drum 26. Heater assembly 34 includes a combustion chamber 36. As discussed above, during operation of dryer appliance 10, motor 28 rotates drum 26 and impeller 43 of air handler 42 such that air handler 42 draws air through chamber 27 of drum 26 when motor 28 rotates impeller 43. In particular, ambient air, shown with arrow $A_a$, enters combustion chamber 36 via an inlet 38 due to air handler 42 urging such ambient air $A_a$ into inlet 38. Such ambient air $A_a$ is heated within combustion chamber 36 and exits combustion chamber 36 as heated air, shown with arrow $A_h$. Air handler 42 draws such heated air $A_h$ through a back duct 40 to drum 26. The heated air $A_h$ enters drum 26 through a plurality of holes 32 defined in rear wall 25 of drum 26.

Within chamber 27, the heated air $A_h$ can accumulate moisture, e.g., from damp articles disposed within chamber 27. In turn, air handler 42 draws moisture laden air, shown as arrow $A_m$, through a screen filter 44 which traps lint particles. Such moisture laden air $A_m$ then enters a front duct 46 and is passed through air handler 42 to an exhaust duct 48. From exhaust duct 48, such moisture laden air $A_m$ passes out of clothes dryer 10 through a vent 49 defined by cabinet 12.

Front duct 46 and exhaust duct 48 form a conduit 47 that extends between and connects chamber 27 of drum 26 and vent 49. Conduit 47 places chamber 27 of drum 26 and vent 49 in fluid communication in order to permit moisture laden air $A_m$ to exit dryer appliance 10. Air handler 42 is in fluid communication with conduit 47, and impeller 43 of air handler 42 is positioned within conduit 47.

A cycle selector knob 50 is mounted on a cabinet backsplash 52 and is in communication with a controller 54. Signals generated in controller 54 operate motor 28 and heater assembly 34 in response to a position of selector knob 50. Alternatively, a touch screen type interface may be provided. As used herein, "processing device" or "controller" may refer to one or more microprocessors or semiconductor devices and is not restricted necessarily to a single element. The processing device can be programmed to operate dryer appliance 10. The processing device may include, or be associated with, one or memory elements such as e.g., electrically erasable, programmable read only memory (EEPROM).

Figure 3:
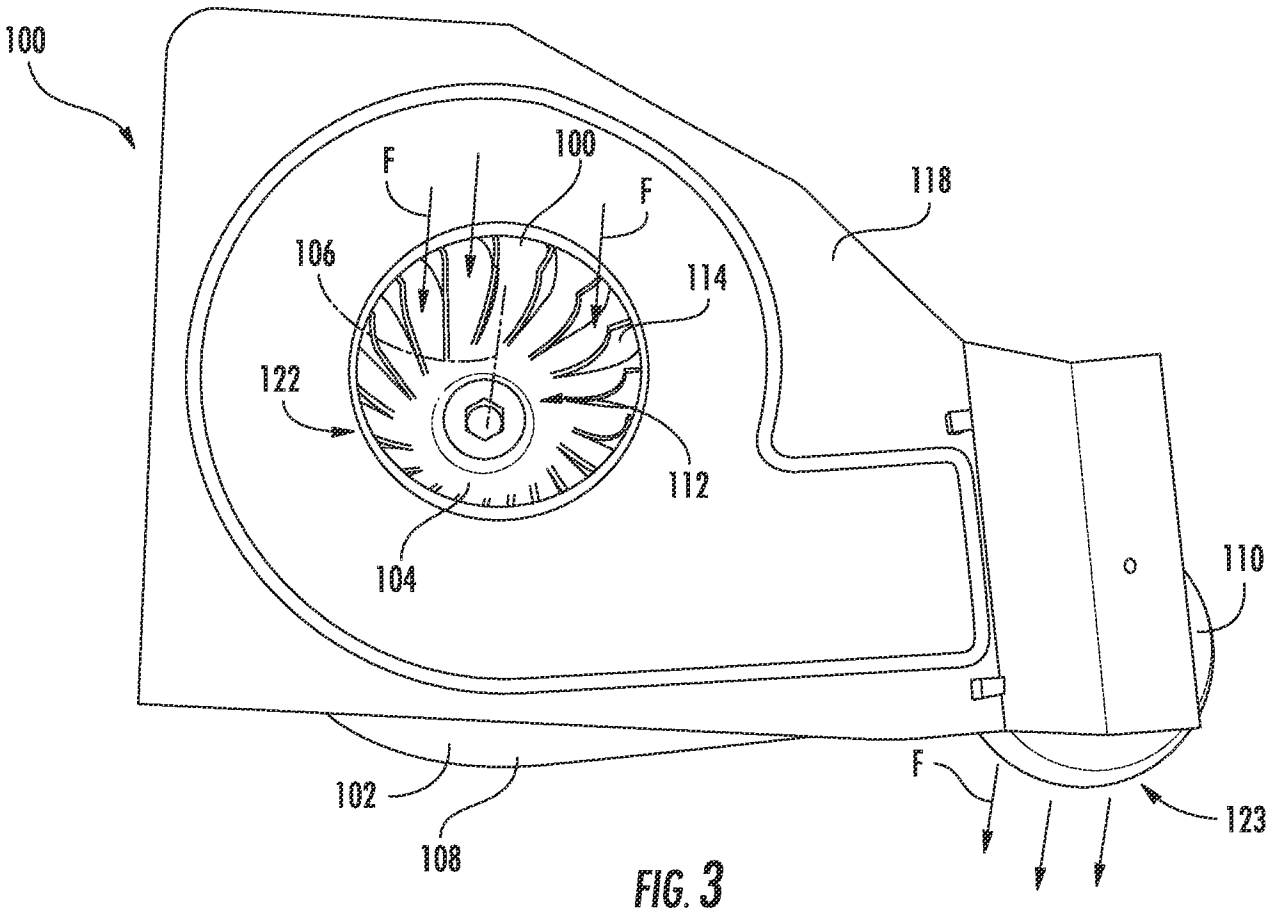
FIG. 3 provides a perspective view of an impeller assembly according to an exemplary embodiment of the present subject matter, including a cover plate.
Figure 4:
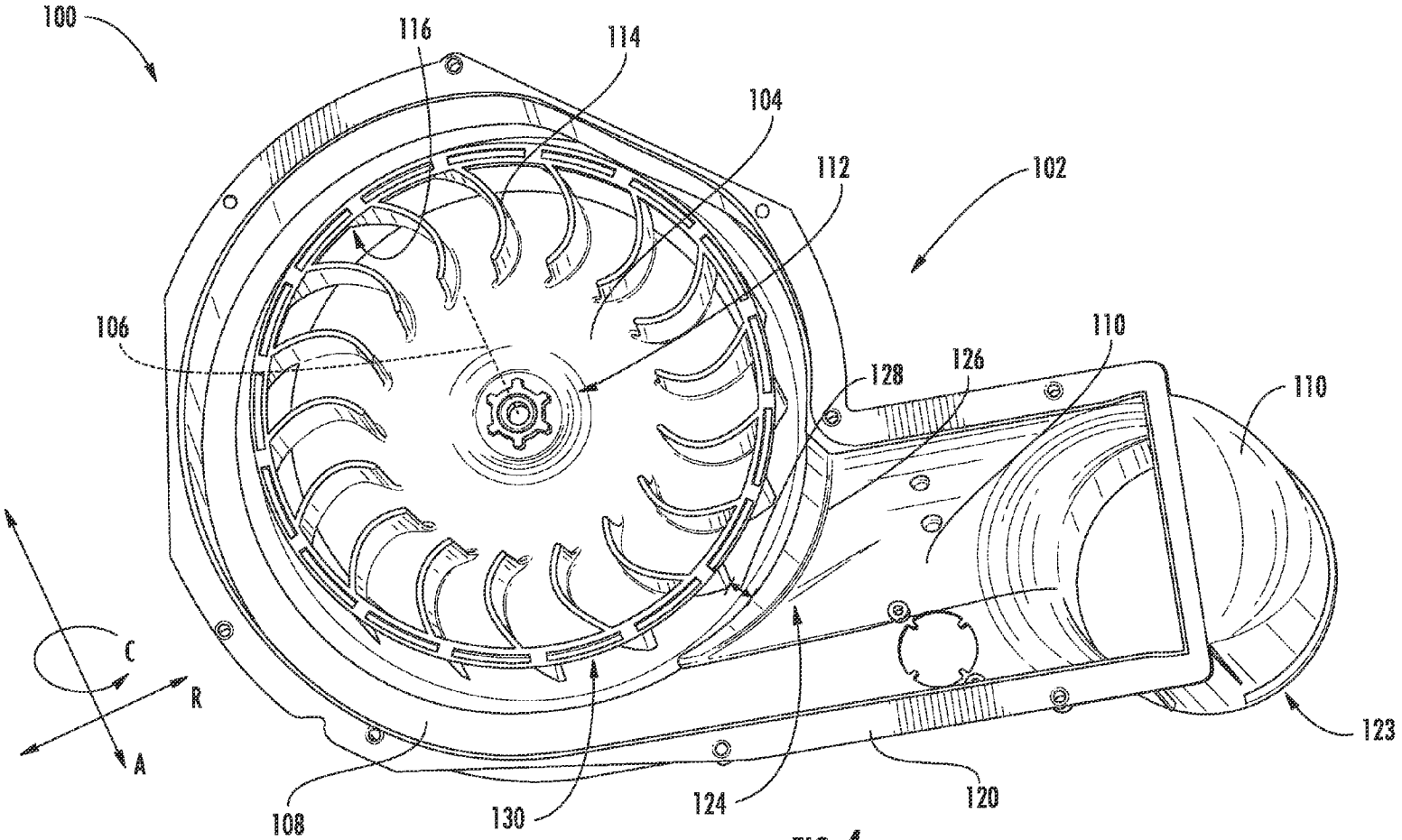
FIG. 4 provides a perspective view of the impeller assembly of FIG. 3, with the cover plate removed for clarity.

Referring now to FIGS. 3 and 4, perspective views are provided of an impeller assembly 100 according to an exemplary embodiment of the present subject matter. More particularly, FIG. 3 provides a perspective view of an impeller assembly 100 according to an exemplary embodiment the present subject matter including a cover plate, while FIG. 4 provides a perspective view of impeller assembly 100 of FIG. 3, with the cover plate removed for clarity.

Impeller assembly 100 may be used in any suitable dryer appliance. For example, impeller assembly 100 may be used in dryer appliance 10, e.g., as air handler 42 (FIG. 2). Thus, impeller assembly 100 may be positioned within cabinet 12, e.g., at front duct 46, such that impeller assembly 100 draws and receives moisture laden air $A_m$ from chamber 27 of drum 26. As discussed in greater detail below, impeller assembly 100 includes features for limiting a spike in sound power level during operation of impeller assembly 100.

Impeller assembly 100 includes a housing 102 and an impeller 104, impeller 104 defining an axial direction A, a radial direction R, and a circumferential direction C (FIG. 4). The axial direction A extends parallel to an axis of rotation 106 of impeller 104. Additionally, housing 102 of impeller assembly 100 generally includes a volute 108 and a transition member 110. Impeller 104 is rotatable about axial direction A, or more particularly, about axis of rotation 106, and is positioned within volute 108 of housing 102. Further, impeller 104 may be placed in mechanical communication with a motor, such as motor 28, that selectively rotates impeller 104 about axis of rotation 106 within housing 102. For example, impeller 104 may be fixed to a shaft of motor 28 such that impeller 104 rotates about axis of rotation 106 within housing 102 (i.e., within volute 108) with motor 28.

As will be discussed in greater detail below with reference to FIG. 5, impeller 104 includes a hub 112 and a plurality of blades 114 spaced about hub 112 along the circumferential direction C. Hub 112 is positioned at a center of the impeller 104, and each of the plurality of blades 114 extend generally outwardly from hub 112 along the radial direction R. Additionally, each of the plurality of blades 114 defines an outer tip 116 (FIG. 4) along the radial direction R.

Impeller assembly 100 additionally includes a cover plate 118 (FIG. 3) mounted to a perimeter flange 120 (FIG. 4) of housing 102. Cover plate 118 may be mounted to perimeter flange 120 of housing 102 in any suitable manner. For example, cover plate 118 may be mounted to perimeter flange 120 of housing 102 using, e.g., one or more screws, bolts, or rivets, or a suitable epoxy. When mounted to housing 102, cover plate 118 is positioned over volute 108 of housing 102 and defines an entrance 122 positioned over a center of impeller 104, e.g., over hub 112 of impeller 104. Housing 102 additionally defines an exhaust exit 123. Entrance 122 of cover plate 118 is configured for receiving the flow of air F into housing 102, and exhaust exit 123 is configured for directing the flow of air F out of housing 102. During operation of impeller assembly 100, impeller 104 may rotate about the axial direction A on axis of rotation 106 within housing 102 such that impeller 104 draws the flow of air F into volute 108 of housing 102 via entrance 122 of cover plate 118. Additionally, impeller 104 may urge the flow of air F from volute 108 of housing 102 to the transition member 110, and through transition member 110 out of exhaust exit 123. In such a manner, impeller 104 may urge or draw the flow of air F through housing 102 during operation of impeller assembly 100. Further, exhaust exit 123 may be fluidly connected to an exhaust duct, such as exhaust duct 48, such that the flow of air F is directed out of housing 102 through exhaust exit 123, and out of, e.g., dryer appliance 10 through exhaust duct 48.

As may be more clearly seen in FIG. 4, housing 102 defines an opening 124 leading to transition member 110 from volute 108, as well as a cut-off edge 126 defined between transition member 110 and volute 108. During operation of impeller assembly 100, impeller 104 may rotate in a counterclockwise manner, as viewed in FIG. 4, and the plurality of blades 114 may urge the flow of air F in a counterclockwise, circumferential direction C and outwardly along radial direction R using centrifugal force. When the blades 114 pass by opening 124, the flow of air F may travel into transition member 110. Cut-off edge 126 is positioned proximate to outer tips 116 of blades 114 such that a desired amount of the flow of air F passes into transition member 110. Accordingly, the outer tips 116 of the blades 114 may define a clearance 128 with cut-off edge 126 of housing 102. In certain embodiments, clearance 128 may be between about one eighth (⅛) of an inch and about one and one half (1½) inches. However, in other embodiments, clearance 128 may instead be between about one quarter (¼) of an inch and about one (1) inch, or alternatively may be between about one half (½) of an inch and about three quarters (¾) of an inch. It should be appreciated, that as used herein terms of approximation, such as "about" or "approximately," refer to being within a ten percent margin of error.

Generally, clearance 128 can be sized to reduce an amount of sound generated by impeller assembly 100 during operation. More particularly, clearance 128 can be increased to reduce an amount of sound generated by outer tips 116 of blades 114 passing by cut-off edge 126. However, such a configuration may reduce an efficiency of impeller assembly 100. As will be described below with reference to FIG. 5, impeller assembly 100 including an impeller 104 in accordance with the present disclosure may allow for a decreased clearance 128 while still generating an acceptable amount of sound during operation of impeller assembly 100. Such a configuration may therefore increase an efficiency of impeller assembly 100.

Figure 5:
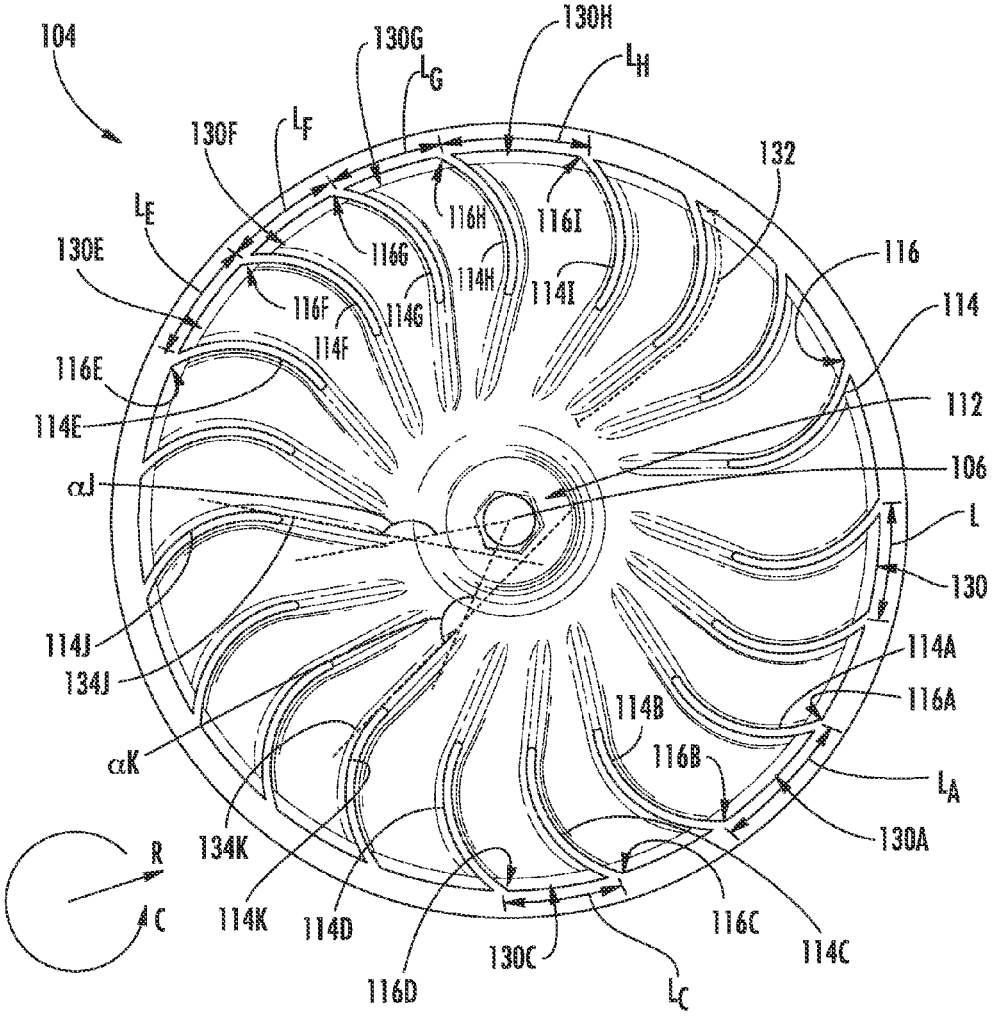
FIG. 5 provides a plan view of an impeller of the exemplary impeller assembly of FIG. 3.

Referring now to FIG. 5, a plan view is provided of the impeller 104 of the exemplary impeller assembly 100 of FIGS. 3 and 4. As shown, impeller 104 generally includes hub 112 positioned at a center of impeller 104 and plurality of blades (referred to generally in FIG. 5 using numeral 114, and specifically using formative thereof) extending generally outwardly from hub 112 along radial direction R. The blades 114 are spaced about hub 112 along circumferential direction C, each defining a respective outer tip (referred to generally in FIG. 5 using numeral 116, and specifically using formative thereof). Additionally, each pair of adjacent blades 114 defines a gap (referred to generally in FIG. 5 using numeral 130, and specifically using formative thereof) having a gap length (referred to generally in FIG. 5 using the letter L, and specifically using formative thereof) between the respective outer tips 116.

For the exemplary embodiment depicted, impeller 104 includes at least a portion of the plurality of blades 114 unevenly spaced about hub 112 along circumferential direction C. For example, impeller 104 of FIG. 5 includes a first pair of blades (blades 114A and 114B) and a second pair of blades (blades 114C and 114D). First pair blades 114A, 114B defines a first gap 130A along the circumferential direction C at a radially outer portion. Similarly, second pair blades 114C, 114D defines a second gap 130C along circumferential direction C at a radially outer portion. More particularly, first pair blades 114A, 114B defines first gap 130A along the circumferential direction C between respective outer tips 116A, 116B, and second pair blades 114C, 114D defines second gap 130C along the circumferential direction C between respective outer tips 116C, 116D. First gap 130A is unequal to second gap 130C.

Moreover, for the embodiment depicted in FIG. 5, gap lengths L of each sequential and adjacent gap 130 are unequal. For example, impeller 104 includes five sequential blades 114E, 114F, 114G, 114H, and 114I defining outer tips 116E, 116F, 116G, 116H, and 116I, respectively. Adjacent blades 114E and 114F define gap 130E having gap length $L_E$ between outer tips 116E and 116F; adjacent blades 114F and 114G define gap 130F having gap length $L_F$ between outer tips 116F and 116G; adjacent blades 114G and 114H define gap 130G having gap length $L_G$ between outer tips 116G and 116H; and adjacent blades 114H and 114I define gap 130H having gap length $L_H$ between outer tips 116H and 116I. For the embodiment depicted, the gap lengths of each of the consecutive gaps are unequal. For example, gap length $L_E$ is unequal to gap length $L_F$; gap length $L_F$ is unequal to gap lengths $L_E$ and $L_G$; gap length $L_G$ is unequal to gap lengths $L_F$ and $L_H$; and gap length $L_H$ is unequal to gap length $L_G$. Such a configuration may prevent a consistent frequency of blades 114 from passing by cut-off edge 126 of housing 102.

In certain exemplary embodiments, a plurality of consecutive gap lengths L may be repeated sequentially about hub 112. For example, the gap lengths L of two consecutive gaps 130 may be repeated sequentially about hub 112. In such an exemplary embodiment, consecutive gaps 130 may define the following gap lengths L: $L_E$, $L_F$, $L_E$, $L_F$, $L_E$, $L_F$, etc. Alternatively, however, the gap lengths L of four consecutive gaps 130 may be repeated sequentially about hub 112. In such an exemplary embodiment, consecutive gaps 130 may define the following gap lengths L: $L_E$, $L_F$, $L_G$, $L_H$, $L_E$, $L_F$, $L_G$, $L_H$, etc. In still other exemplary embodiments, however, the gap lengths L of any other suitable number of consecutive gaps 130 may be sequentially repeated about hub 112. By contrast, however, in still other exemplary embodiments, each gap 130 may define a gap length L unequal to the gap length L of every other gap 130 defined by adjacent blades 116 of impeller 104.

Referring still to FIG. 5, each of the plurality of blades 116 also defines a length 132 and a pitch (referred to herein generally as numeral 134, and specifically using formative thereof). For the embodiment depicted, the lengths 132 of the plurality of blades 116 are all equal, and the pitches 134 of the plurality of blades 116 are also all equal. It should be appreciated, that as used herein, the term "pitch" refers to the initial slope and/or shape of the blade 116 relative to the hub 112. For example, blade 114J has a pitch 134J defining an angle $\alpha_J$ relative to hub 112. Additionally, blade 114K has a pitch 134K defining an angle $\alpha_K$ relative to hub 112. For the embodiment depicted, angle $\alpha_J$ is equal to angle $\alpha_K$.

It should be appreciated, however, that in other exemplary embodiments of the present disclosure, the lengths 132 of the plurality of blades 116 may not all be equal. Additionally, in other exemplary embodiments, the pitches 134 of the plurality of blades 116 may also not all be equal. For example, the pitches 134 of the plurality of blades 116 may be varied to achieve the uneven spacing of blades 114 at outer tips 116.

An impeller 104 in accordance with the present disclosure may reduce a spike in sound power level during operation of the impeller assembly 100. Such is achieved by disrupting the frequency at which outer tips 116 of the plurality of blades 114 pass by cut-off edge 126 of housing 102. By disrupting the frequency at which outer tips 116 the plurality of blades 114 pass by cut-off edge 126 of housing 102, the harmonic tones, i.e., the sound amplitude, may be reduced. Accordingly, such a configuration may allow for a quieter impeller assembly 100 for, e.g., dryer appliance 10. Additionally, such a configuration may allow for a more efficient impeller assembly 100 for, e.g., dryer appliance 10 by allowing for a decreased clearance 128 between outer tips 116 of the plurality of blades 114 and cut-off edge 126 of the housing 102 while still producing an acceptable amount of noise.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An impeller assembly for a dryer appliance, comprising:

a housing including a volute and a transition member, the housing configured to be positioned in a cabinet of the dryer appliance; and an impeller defining an axial direction and a circumferential direction, the impeller rotatable about the axial direction and positioned within the volute of the housing, the impeller configured to urge a flow of air from the volute to the transition member, the impeller including a hub and a plurality of blades, the hub positioned at a center of the impeller and the plurality of blades spaced about the hub along the circumferential direction, each of the plurality of blades defining an outer tip, and each outer tip defining a gap having a gap length with an adjacent outer tip, the gap lengths of consecutive gaps being unequal, and the gap lengths of a plurality of consecutive gaps repeated sequentially.

2. The impeller assembly of claim 1, wherein the gap lengths of two consecutive gaps are repeated sequentially.

3. The impeller assembly of claim 1, wherein the gap lengths of four consecutive gaps are repeated sequentially.

4. The impeller assembly of claim 1, wherein the housing defines a cut-off edge between the volute and the transition member, and wherein the outer tips of the plurality of blades define a clearance with the cut-off edge of the housing, wherein the clearance is between about one quarter of an inch and about one inch.

5. The impeller assembly of claim 1, wherein the plurality of blades each define a pitch relative to the hub, wherein the pitches of the plurality of blades are all equal.

6. The impeller assembly of claim 1, wherein the plurality of blades each define a pitch relative to the hub, wherein the pitches of the plurality of blades are not all equal.

7. The impeller assembly of claim 1, wherein the plurality of blades each define a length, and wherein the lengths of the plurality of blades are all equal.

8. The impeller assembly of claim 1, further comprising a cover plate positioned over the volute of the housing, the cover plate defining an entrance for receiving a flow of air into the volute of the housing.

* * * * *